US007185646B2

(12) United States Patent
Jones

(10) Patent No.: US 7,185,646 B2
(45) Date of Patent: Mar. 6, 2007

(54) PNEUMATIC ASSEMBLY FOR A PAINTBALL GUN

(75) Inventor: Danial Jones, Waterford, MI (US)

(73) Assignee: Smart Parts, Inc., Loyalhanna, PA (US)

( * ) Notice: Subject to any disclaimer, the term of this patent is extended or adjusted under 35 U.S.C. 154(b) by 246 days.

(21) Appl. No.: 10/695,049

(22) Filed: Oct. 27, 2003

(65) Prior Publication Data

US 2005/0115550 A1 Jun. 2, 2005

(51) Int. Cl.
*F41B 11/16* (2006.01)

(52) U.S. Cl. ..... 124/74

(58) Field of Classification Search ..... 124/72–76
See application file for complete search history.

(56) References Cited

U.S. PATENT DOCUMENTS

| | | | | |
|---|---|---|---|---|
| 2,304,320 A | | 12/1942 | Tratsch | 124/77 |
| 2,554,116 A | | 5/1951 | Monner | 124/11 |
| 2,568,432 A | | 9/1951 | Cook | 124/77 |
| 2,594,240 A | | 4/1952 | Wells | 124/13 |
| 2,634,717 A | | 4/1953 | Junkin | 124/11 |
| 2,834,332 A | | 5/1958 | Guthrie | 124/77 |
| 2,845,055 A | | 7/1958 | Collins et al. | 124/32 |
| 2,845,805 A | | 7/1958 | Collins et al. | 124/77 |
| 3,089,476 A | | 5/1963 | Wolverton | 124/77 |
| 3,192,915 A | | 7/1965 | Norris et al. | 124/77 |
| 3,662,729 A | | 5/1972 | Henderson | 124/73 |
| 3,695,246 A | | 10/1972 | Filippi et al. | 124/77 |
| 3,788,298 A | * | 1/1974 | Hale | 124/76 |
| 3,921,980 A | | 11/1975 | Artzer | 124/77 |
| 4,009,536 A | | 3/1977 | Wolff | 42/84 |
| 4,094,294 A | | 6/1978 | Speer | 124/56 |
| 4,269,163 A | | 5/1981 | Feith | 124/77 |
| 4,362,145 A | | 12/1982 | Stelcher | 124/32 |
| 4,730,407 A | | 3/1988 | DeCarlo | 42/84 |
| 4,770,153 A | | 9/1988 | Edelman | 124/77 |
| 4,819,609 A | | 4/1989 | Tippmann | 124/72 |
| 4,899,717 A | | 2/1990 | Rutten et al. | 124/32 |
| 4,936,282 A | | 6/1990 | Dobbins et al. | 124/74 |
| 5,063,905 A | | 11/1991 | Farrell | 124/72 |

(Continued)

FOREIGN PATENT DOCUMENTS

EP 94026535 2/1993

(Continued)

OTHER PUBLICATIONS

CO2 Dynamics, http://www.warpig.com/paintball/technical/gasses/co2dynamics.shtml, Jan. 27, 1999.*

(Continued)

*Primary Examiner*—Michael Carone
*Assistant Examiner*—Troy Chambers
(74) *Attorney, Agent, or Firm*—Marger Johnson & McCollom

(57) ABSTRACT

A pneumatic assembly for a paintball gun preferably includes a bolt slidable between an open and a closed position. The bolt preferably operates as a firing valve by permitting compressed gas to flow through the bolt when the bolt is in the closed position but preventing the transfer of compressed gas through the bolt when in the open position. This can be accomplished, for instance, by arranging a sealing member in communication with a surface of the bolt. A port is also arranged through a lateral sidewall of the bolt at a predetermined location. The bolt preferably slides in relation to the sealing member such that when the bolt is in an open position, the sealing member prevents compressed gas from flowing into the bolt, but when the bolt is in a closed position, compressed gas is permitted to flow into the bolt. Movement of the bolt is preferably controlled using a control valve such as an electronic solenoid valve.

14 Claims, 7 Drawing Sheets

U.S. PATENT DOCUMENTS

| | | | | |
|---|---|---|---|---|
| 5,083,392 | A | 1/1992 | Bookstaber | 42/84 |
| 5,228,427 | A | 7/1993 | Gardner, Jr. | 124/71 |
| 5,261,384 | A | 11/1993 | Hu | 124/66 |
| 5,280,778 | A | 1/1994 | Kotsiopoulos | 124/73 |
| 5,285,765 | A | 2/1994 | Lee | 124/50 |
| 5,333,594 | A | 8/1994 | Robinson | 124/73 |
| 5,337,726 | A | 8/1994 | Wood | 124/61 |
| 5,349,938 | A | 9/1994 | Farrell | 124/73 |
| 5,383,442 | A | 1/1995 | Tippmann | 124/76 |
| 5,413,083 | A | 5/1995 | Jones | 124/32 |
| 5,462,042 | A | 10/1995 | Greenwell | 124/76 |
| 5,515,838 | A | 5/1996 | Anderson | 124/76 |
| 5,572,982 | A * | 11/1996 | Williams | 124/74 |
| 5,613,483 | A | 3/1997 | Lukas et al. | 124/73 |
| 5,778,868 | A * | 7/1998 | Shepherd | 124/76 |
| 5,878,736 | A | 3/1999 | Lotuaco, III | 124/71 |
| 5,881,707 | A | 3/1999 | Gardner, Jr. | 124/77 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,065,460 | A * | 5/2000 | Lotuaco, III | 124/72 |
| 6,343,599 | B1 | 2/2002 | Perrone | 124/33 |
| 6,349,711 | B1 | 2/2002 | Perry et al. | 124/73 |
| 6,474,326 | B1 | 11/2002 | Smith et al. | 124/77 |
| 6,516,791 | B2 | 2/2003 | Perrone | 124/77 |
| 6,520,172 | B2 | 2/2003 | Perrone | 124/74 |
| 6,626,165 | B1 * | 9/2003 | Bhogal | 124/77 |
| 6,637,421 | B2 | 10/2003 | Smith et al. | 124/77 |
| 6,644,295 | B2 | 11/2003 | Jones | 124/77 |
| 6,644,296 | B2 | 11/2003 | Gardner, Jr. | 124/77 |
| 6,701,909 | B2 * | 3/2004 | Tiberius et al. | 124/74 |
| 6,843,388 | B1 * | 1/2005 | Hollars | 222/5 |
| 2002/0096164 | A1 | 7/2002 | Perrone | 124/77 |
| 2002/0170551 | A1 | 11/2002 | Kotsiopoulos et al. | 124/54 |
| 2003/0005918 | A1 | 1/2003 | Jones | 124/70 |

FOREIGN PATENT DOCUMENTS

| | | |
|---|---|---|
| GB | 2146416 | 4/1985 |
| GB | 2313655 | 12/1997 |
| GB | 2313655 A | 12/1997 |
| JP | 1179898 | 7/1989 |
| JP | 7004892 | 1/1995 |
| WO | WO 97/26498 | 6/1997 |

OTHER PUBLICATIONS

Lot of 3 CO2 bottles, Ebay sale Apr. 13, 2005.*

Matrix-Main Body Assembly & Parts Listing at http://www.directpaintball.com/pics/diablomatrix/matrixparts.gif. 3 pages.

Matrix-Main Boby Assembly & Parts Listing at http://www.directpaintball.com/pics/diablomatrix/matrixparts.gif. 3 pages.

Techno Paintball- information reviews articles forum auction and chat at http://www.technopaintball.com/matrixreview.htm 2 pages.

* cited by examiner

PNEUMATIC ASSEMBLY FOR A PAINTBALL GUN

BACKGROUND OF THE INVENTION

This invention relates generally to pneumatic paintball guns ("markers") and their operating components. In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate and accuracy.

SUMMARY OF THE INVENTION

In one embodiment of the present invention, a pneumatic assembly for a paintball gun includes a compressed gas storage chamber and a bolt. The storage chamber can be configured to receive a regulated supply of compressed gas. The bolt is configured to slide back and forth between an open (preferably rearward) and a closed (preferably forward) position to load a paintball into a breech of the paintball gun and to control the release of compressed gas from the compressed gas storage area into the bolt to launch the paintball.

In a preferred embodiment, the bolt is configured to operate as part of a firing valve of the pneumatic assembly. More particularly, one or more ports are preferably disposed through a lateral wall of the bolt at a predetermined distance from an end (preferably a forward end) of the bolt. The bolt port(s) are preferably arranged to selectively permit the transfer of compressed gas into the bolt from a compressed gas storage area. Most preferably, the bolt port(s) convey compressed gas into the bolt when the bolt is disposed in a closed position, but not when the bolt is in an open position. This can be accomplished in any number of different ways.

In one embodiment, a sealing member is arranged in communication with the bolt at a predetermined distance from the front of the assembly. The sealing member preferably keeps compressed gas from passing through the bolt port(s) into the bolt when the bolt is in an open position. In a closed position, however, compressed gas is allowed to pass through the port(s) into the bolt. The compressed gas then flows through the bolt to launch a paintball.

In one specific embodiment, for example, the bolt can be arranged on a valve stem. A sealing member is preferably arranged on a forward end of the valve stem. In this embodiment, the sealing member is preferably in communication with an internal surface of the bolt. In another embodiment, a sealing member could be arranged in communication with an external surface of the bolt at a predetermined distance from the front of the assembly. In these specific embodiments, as the bolt travels toward its closed position, the bolt port(s) preferably slide past the sealing member and permit compressed gas to flow from the compressed gas storage area into the bolt as the bolt closes.

According to another aspect of the present invention, a paintball gun comprising a pneumatic assembly preferably includes a body having a breech. The pneumatic assembly preferably includes a compressed gas storage chamber and a bolt. The bolt is preferably configured to move to a closed position in the breech to move a paintball into a firing position and to cause compressed gas to be released through the bolt into the breech.

Interchangeable compressed gas storage chambers can be provided having varying internal volumes. These chambers can be color-coded and/or provided with other visual indicia that correspond to their volumes. A viewing aperture can be provided through a lateral wall of the paintball gun body to permit viewing of the storage chamber or other internal components.

The paintball gun may also include a control valve, such as an electronic solenoid valve or a mechanical valve configured to initiate forward movement of the bolt in response to a trigger pull. The control valve can also be used to control rearward movement of the bolt. An electronic eye can also be arranged in the paintball gun in a manner such that no external wiring is required.

Various other aspects, embodiments, and configurations of this invention are also possible without departing from the principles disclosed herein. This invention is not limited to any of the particular aspects, embodiments, or configurations described herein.

BRIEF DESCRIPTION OF THE DRAWINGS

The foregoing objects, features, and advantages of the present invention will become more readily apparent from the following detailed description of preferred embodiments thereof, made with reference to the accompanying figures, in which.

DETAILED DESCRIPTION OF PREFERRED EMBODIMENTS

Figure 1A:
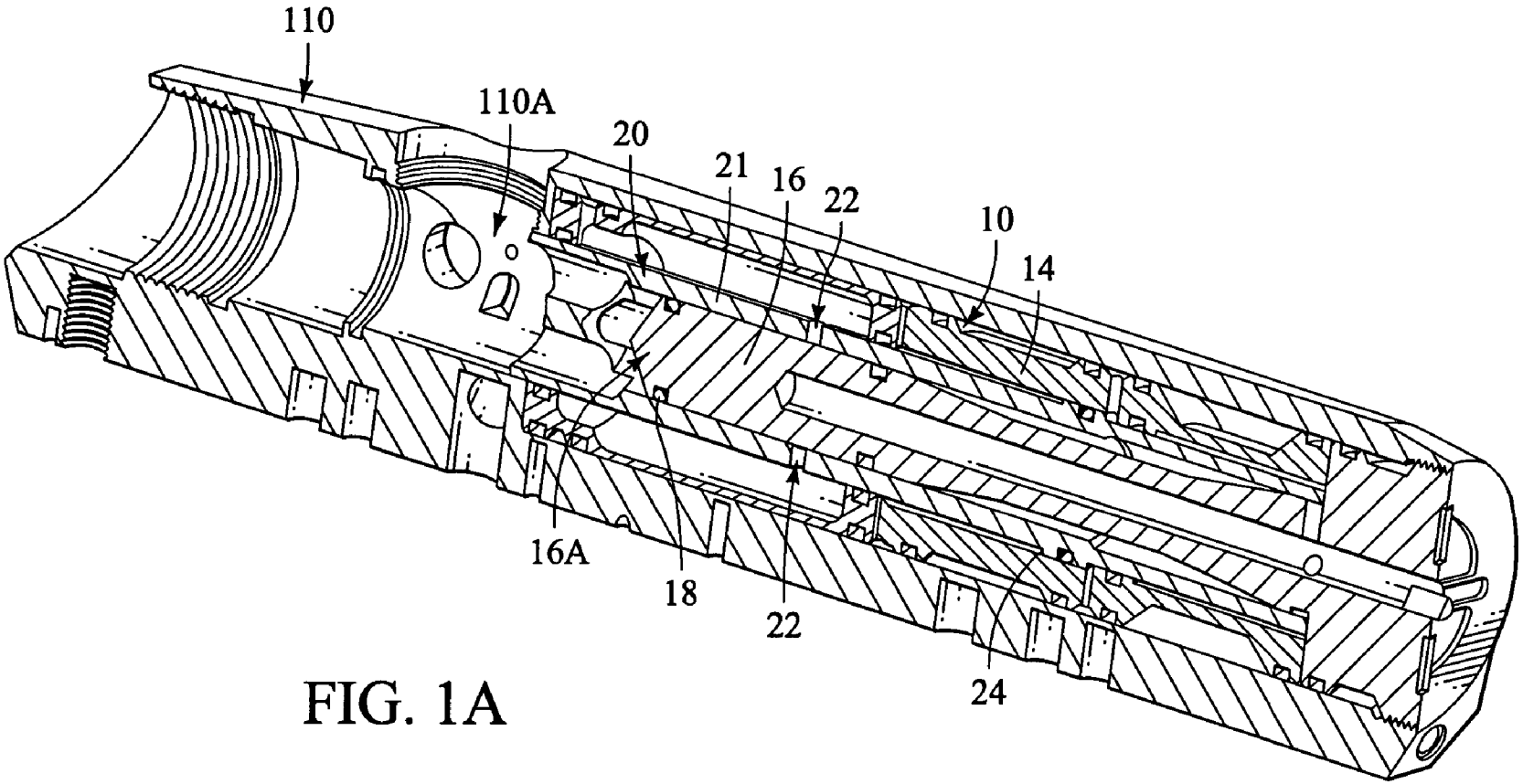
FIG. 1A is a cross-sectional perspective view of a paintball gun body having a pneumatic assembly according to one aspect of the present invention, wherein a bolt thereof is disposed in an open position.

The accompanying drawings illustrate the construction of preferred embodiments of the present inventive concepts. Referring first to FIGS. 1A, 1B, 2A, and 2B, a pneumatic assembly 10 is preferably arranged in a paintball gun body 110. The pneumatic assembly 10 preferably includes a compressed gas storage chamber 12 and a pneumatic cylinder 14. A piston 24 is slidably arranged in the pneumatic cylinder 14. A bolt 20 is preferably disposed through the compressed gas storage chamber 12 and coupled to (or formed integrally with) the piston 24. In this embodiment, the bolt 20 is slidably mounted on a valve stem 16. The valve stem 16 preferably comprises a sealing member 18 arranged on a forward end 16A thereof. The bolt 20 preferably comprises one or more ports 22 arranged through a lateral sidewall 21 of the bolt 20.

Figure 1B:
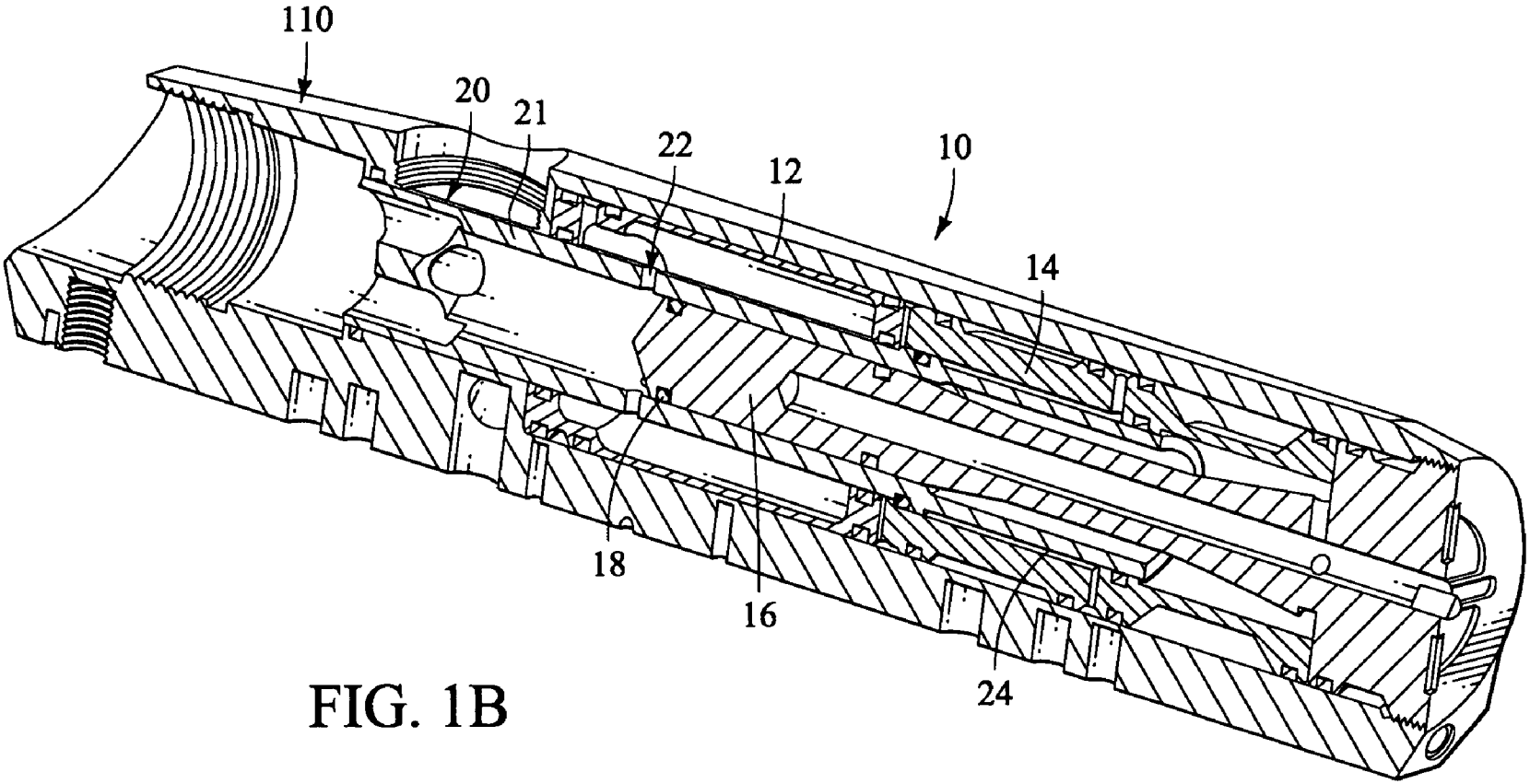
FIG. 1B is a cross-sectional perspective view of the paintball gun body and pneumatic assembly of FIG. 1A, wherein the bolt is disposed in a closed position.
Figure 2A:
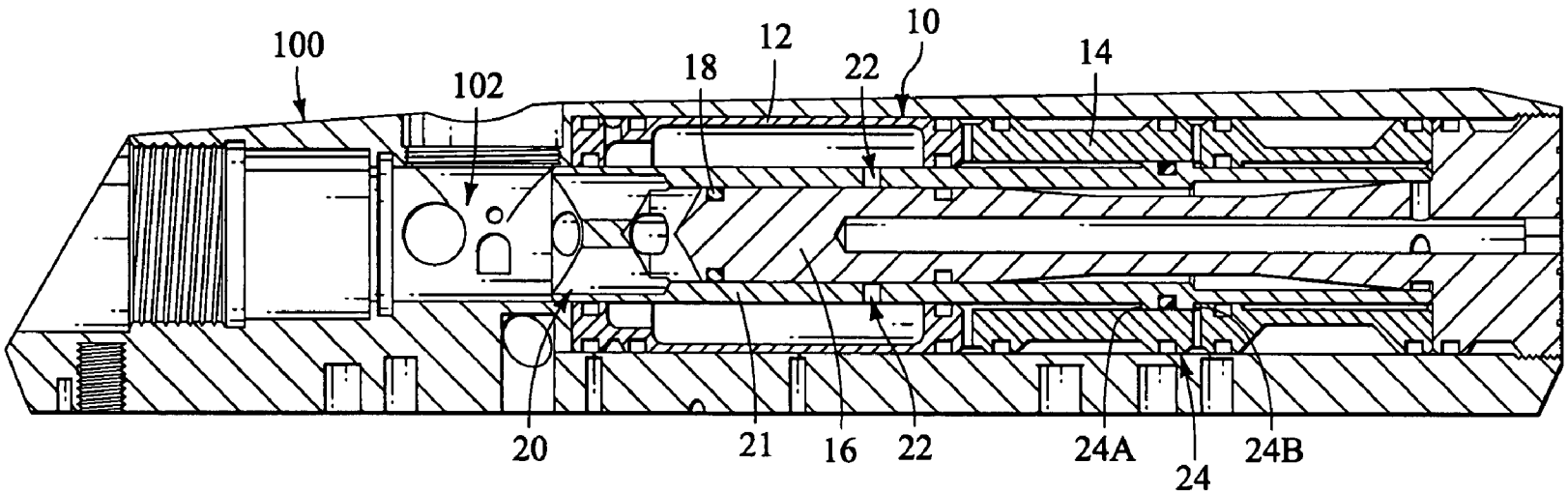
FIG. 2A is a cross-sectional side view of the paintball gun body and pneumatic assembly of FIG. 1A, wherein the bolt is disposed in the open position.
Figure 2B:
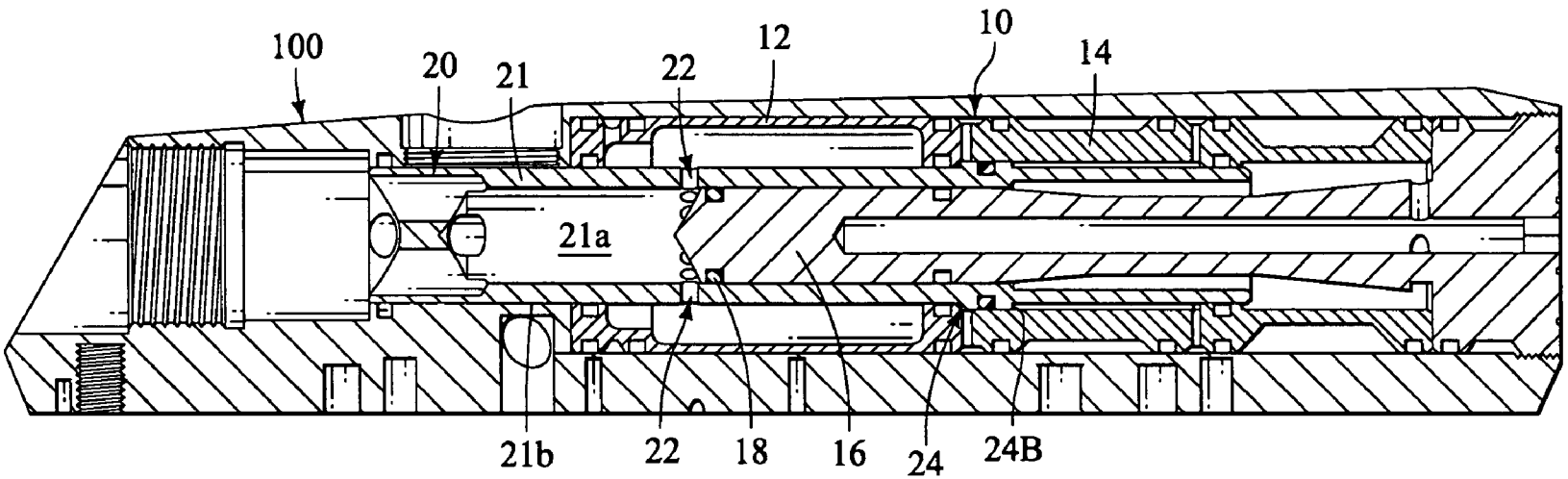
FIG. 2B is a cross-sectional side view of the paintball gun body and pneumatic assembly of FIG. 1A, wherein the bolt is disposed in the closed position.

Referring specifically to FIGS. 1A and 2A, when the bolt 20 is open (in this case, rearward), the sealing member 18 prevents compressed gas from flowing through the bolt ports 22 into the bolt 20. When the bolt 20 is closed (in this case, in a forward position), as shown in FIGS. 1B and 2B, however, compressed gas from the compressed gas storage chamber 12 is permitted to flow through the bolt ports 22 into the bolt 20.

As noted previously, the bolt 20 is preferably connected to a pneumatic piston 24 (such as through a separate mechanical linkage, by integral formation therewith, or in some other manner). The pneumatic piston 24 is, in turn, preferably configured to slide back and forth in the pneumatic cylinder 14. Movement of the bolt 20 is therefore preferably controlled by controlling movement of the pneumatic piston 24. Movement of the pneumatic piston 24 can be controlled, for instance, by a mechanical or electrical pneumatic valve.

Figure 3A:
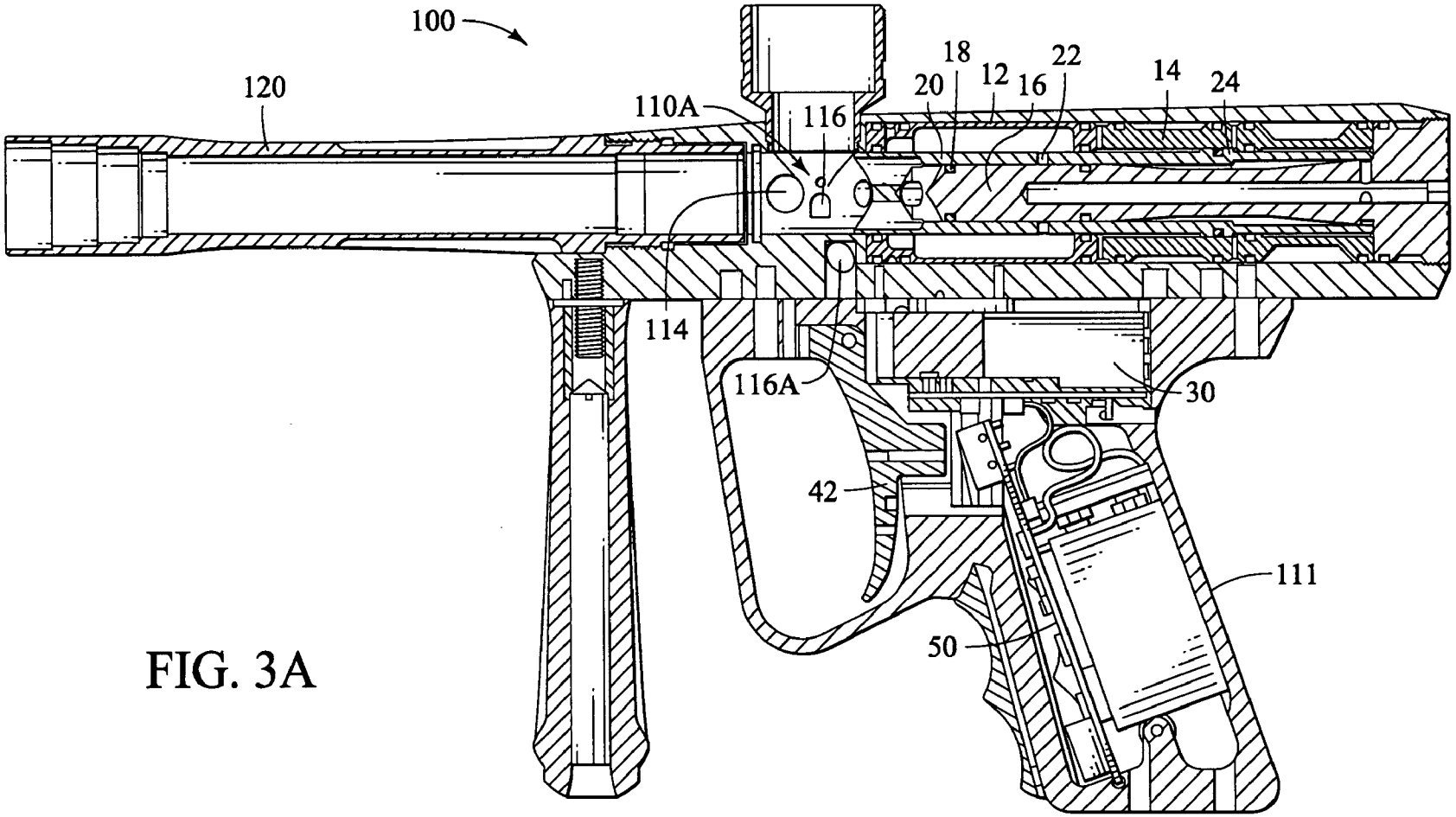
FIG. 3A is a cross-sectional side view of a paintball gun employing the paintball gun body and pneumatic assembly shown in FIG. 1A, wherein the bolt is disposed in the open position.
Figure 3B:
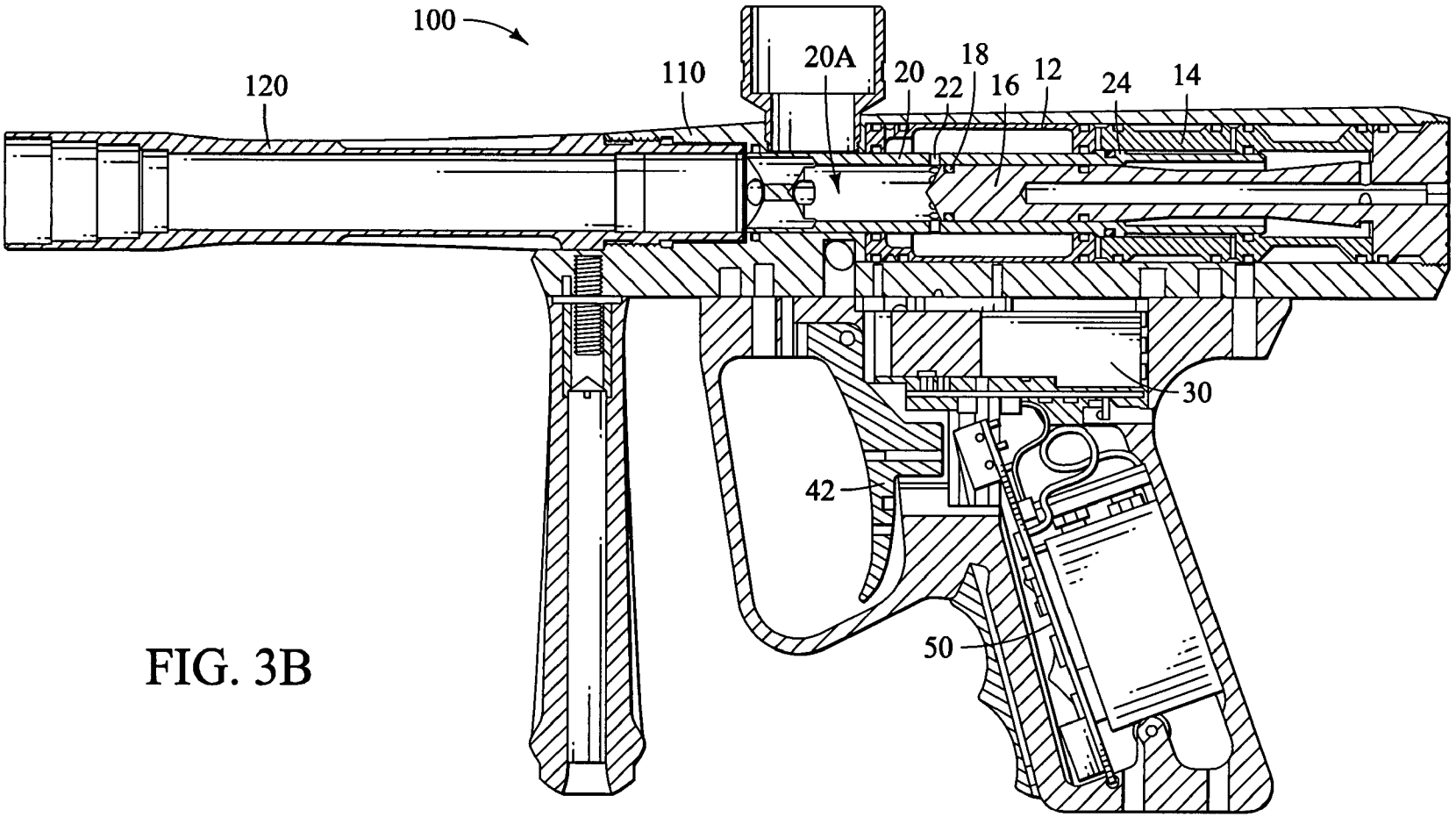
FIG. 3B is a cross-sectional side view of a paintball gun employing the paintball gun body and pneumatic assembly shown in FIG. 1A, wherein the bolt is disposed in the closed position.

Referring now to FIGS. 3A and 3B, operation of a preferred embodiment of a paintball gun 100 employing the pneumatic assembly 10 of FIGS. 1A–2B is as follows. When the bolt 20 is disposed in an open position, a paintball is permitted to drop into the breech area 110A of the paintball gun body 110. A mechanical or electrical pneumatic valve 30 (preferably an electronic solenoid valve) initiates a firing operation in response to a pull on the trigger 42. During the firing operation, the pneumatic piston 24 moves forward under control of the pneumatic valve 30. The bolt 20 is carried forward by the movement of the pneumatic piston 24. As the bolt 20 moves forward, the paintball is loaded into a firing position in a barrel 120 connected to the breech end of the paintball gun body 110. At the same time, the bolt ports 22 slide past the sealing member 18 and an internal chamber 20A of the bolt 20 is exposed to the compressed gas from the compressed gas storage chamber 12 through the bolt ports 22. Compressed gas from the compressed gas storage chamber 12 is thereby permitted to flow into and through the bolt 20 to launch the paintball.

According to this embodiment, the bolt 20 of the pneumatic paintball gun preferably operates as a portion of a firing valve. More specifically, the bolt ports 22, formed through the bolt wall 21 at a predetermined position along the bolt 20, are configured to selectively permit and prevent compressed gas from entering the bolt 20. This is preferably accomplished by positioning the ports 22 in a desired relation to the sealing member 18. When the bolt 20 is open, a sealing engagement between the bolt 20 and the sealing member 18 preferably prevents compressed gas from entering the ports 22. When the bolt 20 closes, however, the ports 22 transmit compressed gas from a compressed gas storage area 12 into an internal bolt chamber 20A. The compressed gas then flows through the bolt 20 to launch a paintball.

Where the bolt 20 is slidably mounted on a valve stem 16, a sealing member 18 (such as an O-ring, plug, or any other sealing structure) is preferably arranged at a forward end 16A of the valve stem 16. The sealing member 18 thereby prevents compressed gas from entering the bolt 20 from the compressed gas storage area 12 until the bolt 20 reaches a predetermined forward position. As the bolt 20 approaches its predetermined forward position, the bolt ports 22 slide past the sealing member 18 and expose an internal bolt chamber 20A to compressed gas from the storage chamber 12.

It should be noted, however, that many alternative embodiments are possible, without departing from the inventive principles disclosed herein. In one alternative embodiment, for example, a sealing member can be arranged in communication with an external surface of the bolt. As in the earlier embodiment, the sealing member prevents compressed gas from entering the bolt from a compressed gas source until the bolt reaches a closed position. As the bolt closes, the gas entry ports preferably slide past the sealing member and permit compressed gas to enter the bolt and flow into communication with a paintball, thereby launching the paintball from the marker.

Referring to FIGS. 1A–3B, movement of the bolt 20 is preferably accomplished using an electronic solenoid valve 30. The bolt 20 can, for instance, include two, oppositely arranged piston surface areas 24A, 24B formed on a rearward portion of the bolt 20. The solenoid valve 30 can then be configured to alternately supply compressed gas to and vent compressed gas from the two surface areas 24A, 24B. More particularly, compressed gas is preferably supplied from the solenoid valve 30 to a forward surface area 24A and vented from a rearward surface area 24B to move the bolt to a rearward position. The compressed gas is preferably supplied to the rearward surface area 24B and vented from the forward surface 24A area to move the bolt to a forward position.

Although this configuration preferably uses a single, four-way solenoid valve, various types, numbers, and configurations of solenoid valves can be used to shuttle the bolt between a forward and rearward position. In one alternative embodiment, for instance, a constant supply of compressed gas can be directed to a first piston surface area, with compressed gas being selectively supplied through a three-way solenoid valve to an opposite, larger surface area to operate the bolt. Furthermore, the bolt could be connected to a separate pneumatic piston rather than have piston surface areas formed directly thereon.

Figure 4:
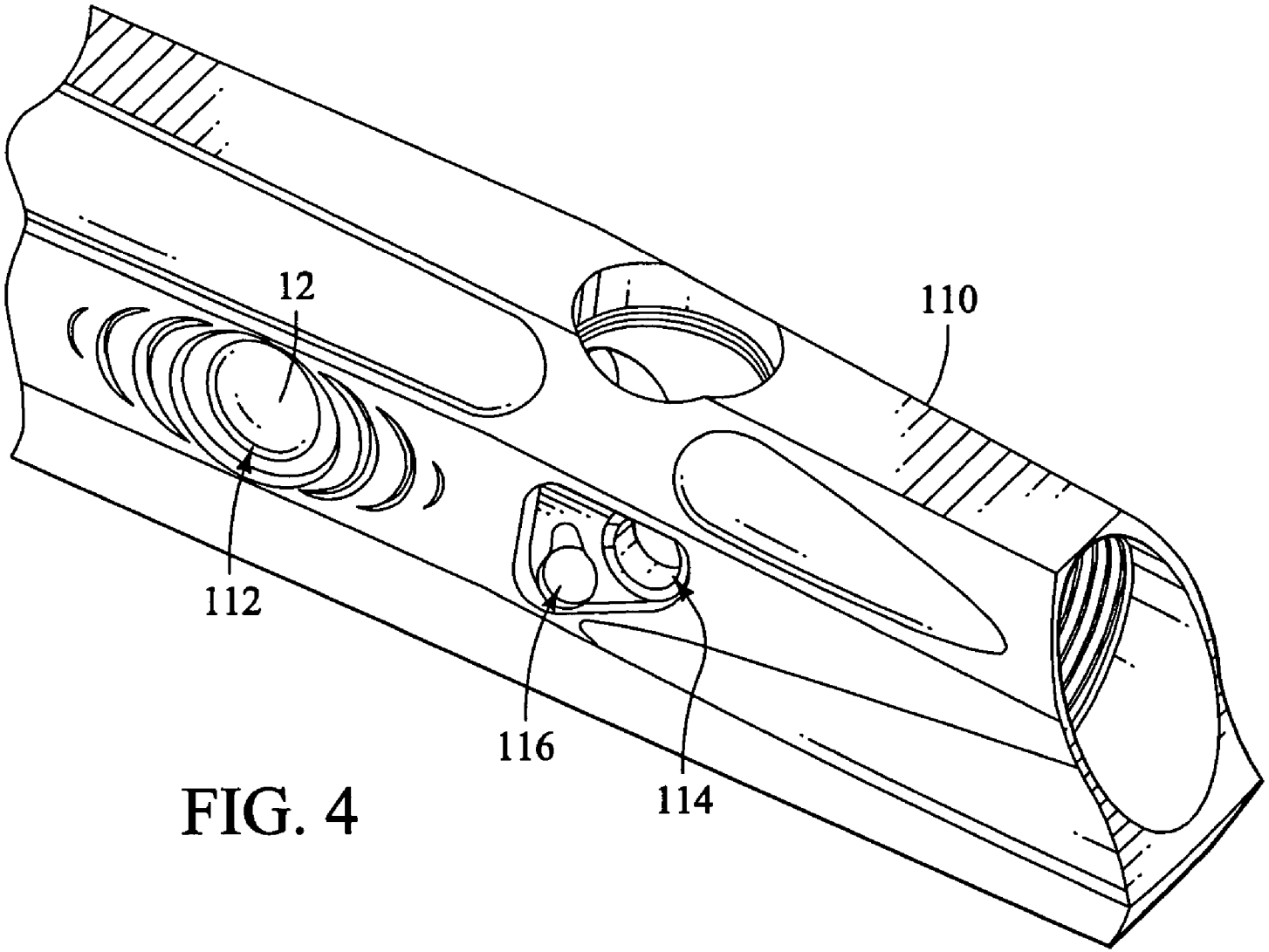
FIG. 4 is a perspective view of a paintball gun employing a pneumatic assembly according to yet another embodiment of the present inventive concepts.

Referring now to FIG. 4, a paintball gun body 100, embodies various additional inventive principles. In particular, the paintball gun body 110 shown in FIG. 4 preferably includes a viewing aperture 112 arranged through a lateral wall 101 of the paintball gun body 110. A detent aperture 114 can be provided for positioning of a ball detent to prevent double feeding of paintballs. An eye aperture 116 can be provided through the body wall 101 for the positioning of an electronic eye (not shown). The electronic eye preferably senses the presence or absence of a paintball in the breech area 110A of the paintball gun body 110 to prevent misfiring. A wiring aperture 116A can also be provided from the breech area 110A to a grip 111 of the paintball gun 100 (see FIG. 3A) to permit attachment of the electronic eye to a circuit board 50 (see FIG. 3A) of the paintball gun 100 without any external wiring.

According to yet another aspect of this invention, a plurality of compressed gas storage chambers 12 can be provided, the compressed gas storage chambers 12 having different internal volumes. Different internal volumes may be desirable to permit firing of a paintball at a desired velocity using a different gas pressure. Selecting an appropriate chamber volume can also improve gas efficiency. In one embodiment, the plurality of compressed gas storage chambers 12 can be provided with indicators 12A, such as different colors (represented by stippling marks), numbers, or other indicators, that represent an internal volume of the chamber 12. When arranged in the paintball gun body 110, this indicator 12A can preferably be viewed through the viewing aperture 112 in the gun body 110 to permit quick visual determination of the internal volume of the compressed gas storage chamber 12. These indicators 12A can indicate an actual volume, a relative volume (as compared to other chambers or some independent reference value), or both.

Having described and illustrated the principles of the invention through the descriptions of various preferred embodiments thereof, it will be readily apparent to those skilled in the art that the invention can be modified in arrangement and detail without departing from such principles. The claims should be interpreted to cover all such variations and modifications.

What is claimed is:

1. A pneumatic assembly for a paintball gun, comprising:

a valve stem;

a bolt slidably mounted on the valve stem and having a bolt port arranged through a sidewall of the bolt; and a sealing member arranged on the valve stem in communication with an inner surface of the bolt.

2. A pneumatic assembly according to claim 1, further comprising a plurality of bolt ports disposed through the sidewall of the bolt at a predetermined location along the bolt, wherein the plurality of bolt ports are configured to slide past the sealing member on the valve stem as the bolt transitions from an open position to a closed position.

3. A pneumatic assembly according to claim 1, further comprising a pneumatic piston slidably mounted in a cylinder, the cylinder configured to receive and apply compressed gas to the pneumatic piston to control movement of the pneumatic piston, wherein the bolt is coupled to the pneumatic piston, and wherein the bolt is configured to be closed by selectively supplying compressed gas to a rearward surface area of the piston.

4. A pneumatic assembly according to claim 1, further comprising a compressed gas storage area surrounding at least a portion of the bolt, wherein the compressed gas storage area is configured to receive a supply of compressed gas and to supply compressed gas directly to an interior of the bolt through the bolt port arranged through the sidewall of the bolt when the bolt is in a closed position.

5. A pneumatic assembly according to claim 4, wherein the compressed gas storage area is housed in a chamber body comprising an external indicator representing a volume of the compressed gas storage area.

6. A pneumatic assembly according to claim 5, wherein the external indicator is a color.

7. A pneumatic assembly according to claim 4, further comprising a plurality of interchangeable compressed gas storage chambers, each compressed gas storage chamber capable of providing the compressed gas storage area, and each compressed gas storage chamber having a different volume from the other compressed gas storage chambers.

8. A pneumatic assembly according to claim 7, wherein each compressed gas storage chamber comprises an indicator representing a volume thereof relative to the volumes of the other compressed gas storage chambers.

9. A paintball gun, comprising:

a body;

a compressed gas storage area arranged within the body;

a bolt slidably arranged within the body and configured to receive compressed gas directly from the compressed gas storage area through a bolt port arranged through a sidewall of the bolt and transmit the compressed gas into a breech area of the paintball gun; and a sealing member arranged in a fixed position with respect to the body of the paintball gun, the sealing member further arranged in communication with a surface of the bolt, wherein the sealing member is arranged in communication with an internal surface of the bolt.

10. A paintball gun according to claim 9, wherein the bolt is slidably mounted on a valve stem and wherein the sealing member is arranged on a forward end of the valve stem.

11. A paintball gun according to claim 9, wherein the compressed gas storage area is configured to receive a substantially constant supply of compressed gas from a compressed gas source.

12. A paintball gun according to claim 9, wherein the sealing member is configured to prevent a forward end of the bolt from receiving compressed gas from the compressed gas storage area through the bolt port when the bolt is in an open position and to allow the forward end of the bolt to directly receive compressed gas from the compressed gas storage area through the bolt port when the bolt is in a closed position.

13. A paintball gun according to claim 1, wherein the sealing member is configured to prevent a forward end of the bolt from receiving compressed gas from a compressed gas storage area through a bolt port when the bolt is in an open position and to allow the forward end of the bolt to directly receive compressed gas from the compressed gas storage area through the bolt port when the bolt is in a closed position.

14. A pneumatic assembly for a paintball gun, comprising:

a valve stem;

a bolt slidably mounted on the valve stem, said bolt having a plurality of bolt ports arranged through a sidewall of the bolt and a firing port arranged through a forward end of the bolt; and a sealing member arranged on the valve stem in communication with an inner surface of the bolt, wherein when the bolt is in an open position the sealing member prevents communication between a compressed storage area and the firing port, and when the bolt is in a closed position compressed gas is permitted to travel from the compressed gas storage chamber into the bolt through the plurality of bolt ports and out the firing port.

* * * * *